United States Patent [19]

Daniel et al.

[11] Patent Number: 4,717,391

[45] Date of Patent: Jan. 5, 1988

[54] METHOD FOR SPRAYING OF DYES FROM HIGH-BOILING SOLVENT DISPERSIONS ONTO OPEN WIDTH FABRIC WITH HEAT SETTING

[75] Inventors: Vernon T. Daniel, Oak Ridge; Jessie Gettliffe, Greensboro, both of N.C.

[73] Assignee: Burlington Industries, Inc., Greensboro, N.C.

[21] Appl. No.: 935,716

[22] Filed: Nov. 28, 1986

[51] Int. Cl.[4] ..... D06P 7/00

[52] U.S. Cl. ..... 8/489; 8/149.1; 8/151; 8/492; 8/494; 8/497; 8/499; 8/938; 68/5 C; 68/5 D; 68/28; 68/207

[58] Field of Search ..... 8/489, 492, 494, 499, 8/149.1

[56] References Cited

U.S. PATENT DOCUMENTS

| | | | |
|---|---|---|---|
| 3,530,214 | 9/1970 | Hermes | 264/342 R |
| 3,771,949 | 11/1973 | Hermes | 8/492 |
| 3,787,180 | 1/1974 | Wesmuller et al. | 8/938 |
| 3,804,589 | 4/1974 | Dawson et al. | 8/614 |
| 4,047,889 | 9/1977 | Hermes | 8/938 |
| 4,055,971 | 11/1977 | Hermes | 68/9 |
| 4,293,305 | 10/1981 | Wilson | 8/115.6 |
| 4,550,579 | 11/1985 | Clifford | 68/5 C |

*Primary Examiner*—A. Lionel Clingman

*Attorney, Agent, or Firm*—Nixon & Vanderhye

[57] ABSTRACT

Textile fabrics are dyed in open widths in a closed, heated environment by spraying a heated dye composition containing a dyestuff dispersed in a non-aqueous, high-boiling solvent, without the dye applicator directly contacting the fabric, directly onto the fabric. The sprayed fabric is held under transverse tension in a heated (350° to 450° F.) environment and further heated while the sprayed dye dispersion migrates, penetrates thoroughly through the fabric and levels substantially evenly across the width of the fabric. Fabrics are thus simultaneously uniformly dyed and uniformly heatset. Apparatus for conducting the process is also disclosed.

9 Claims, 4 Drawing Figures

METHOD FOR SPRAYING OF DYES FROM HIGH-BOILING SOLVENT DISPERSIONS ONTO OPEN WIDTH FABRIC WITH HEAT SETTING

This invention relates to the dyeing of fabrics. More particularly, it relates to a process of dyeing fabrics in open widths by spraying or otherwise applying a dye composition containing a dye dispersed in a substantially non-aqueous high-boiling solvent.

BACKGROUND OF THE INVENTION

Dye compositions have been applied in the past to fabrics and garments using numerous procedures. With the advent of high-boiling solvent dispersions, for instance substantially non-aqueous systems containing a solvent with a boiling point greater than that of water and of the aromatic ester or cycloaliphatic diester type as disclosed, for instance, in U.S. Pat. No. 4,293,305 (Wilson) as well as others, special requirements must be satisfied. It has been found that the elevated temperatures used in dyeing with the non-aqueous high-boiling solvent dispersions facilitate level fabric dyeing by swelling the synthetic fibers and relieving the heat history characteristics of the fabric. Non-contact means of applying dyes dispersed in high-boiling solvent to the fabric while the fabric is on width-holding chains are needed to allow simultaneous dyeing and heatsetting of the fabric. This is particularly the case since the high-boiling solvent dispersions are designed to operate most efficiently at elevated temperatures. Application of the dye dispersion at elevated temperatures while the fabric is under tension in a heated atmosphere allows for the simultaneous dyeing of the fabric and heatsetting the goods in open width.

Prior procedures for applying dyes in high-boiling solvent dispersions in open width have included dipping the fabric in a tank filled with the hot dye dispersion. This method requires large volumes of dye and, over a period of time, the dye becomes exhausted from the pad bath as evidenced by shade changes that occur during the dyeing run. Another proposal is to flood the fabric with recirculated dye dispersion; this procedure also has difficulties, namely the need for large volumes of the solvent dispersions, which solvents are relatively expensive, as well as dye exhaust problems during operation. As described in U.S. Pat. No. 4,550,579 to Clifford, a constantly moving thin film flowing very rapidly is directed over a shaped article, not goods in open width. This procedure is said to allow continuous exposure of the shaped article, such as a finished garment, to fresh dye composition to keep the article to be dyed in contact with the dye composition throughout the entire dyeing process. The dyeing process is conducted at a substantially uniform temperature. A non-reactive environment is also provided to surround the thin film dye bath to prevent degradation of the dye composition. This patent cautions that spray or shower techniques permit dye degradation when a sprayed dye-containing composition is exposed to the surrounding ambient atmosphere, allows for significant heat loss (where the dye composition is itself heated), and at elevated temperatures may cause significant dye degradation due to mixing with the ambient air.

U.S. Pat. No. 4,055,971 to Hermes describes a closed cycle dyeing, washing and solvent recovery apparatus in which a textile material is dyed in an enclosed chamber using a glycol as the high-boiling organic liquid. As depicted in the drawings, the dyestuff material, consisting of a dye plus high-boiling solvent, is applied to the cloth using a contact method (pad bath) outside of the chamber then led through the enclosed chamber through a tortuous path on a series of rolls.

High-boiling solvent dispersions have specific requirements not shared with aqueous-based systems. Thus, for aqueous systems, non-contact applicators, such as spray nozzles or a dyebath cascade are unsuited, according to conventional wisdom, because the dye-containing composition is applied unevenly to the fabric and a streaked, moire-dyed fabric results. We have found a dyeing process that is forgiving in that it permits uneven dye dispersion application, i.e., areas of fabric that are not completely contacted with the dye dispersion and areas of fabric that receive excessive dye dispersion, yet a level shade almost invariably results. These dye-containing liquids are correctly termed dispersions since only a fraction of the amount of dye normally used is truly soluble in the hot high-boiling solvent under operating conditions.

It is an object of the present invention to dye and heatset flat goods simultaneously and to utilize the advantages attendant on dyeing at high temperatures. The process takes full advantage of applying high-boiling solvent dispersions in a hot environment while the fabric to which these hot dispersions are applied is held in open width under tension. The process allows for careful control of the fabric wet pick-up, that is the amount of solvent dispersion provided to the fabric; the level of tension applied across the width of the fabric; and control of the level of dyeing of the fabric. Unlike previous proposals which require large quantities of solvent dispersion, the procedure described in more detail below allows for rapid color changes as well as for changing the width at which the high-boiling solvent dye dispersion is applied to accommodate changes in fabric width.

The invention is a continuous process for simultaneously uniformly solvent dyeing and uniformly heatsetting a fabric in open width at an elevated temperature in a closed environment. The process is conducted in a heated, enclosed chamber such as a tenter frame which holds fabric by the edges in open width. The chamber includes a dye applicator for applying a dyestuff-containing dispersion directly to the fabric without the applicator directly contacting the fabric, and a conveyor to move the fabric through the chamber.

The fabric is supplied in open width and passed through the heated, enclosed chamber while adjusting the fabric width, as required, as the fabric passes through the chamber. A heated dispersion of a dyestuff dispersed in a non-aqueous, high-boiling solvent is applied to the fabric while in open width in the heated chamber where the fabric is exposed to heat while the dye dispersion is in contact with the fabric. This allows the dye dispersion to migrate, penetrate thoroughly through the fabric and level substantially evenly across the entire width of the fabric thereby simultaneously uniformly dyeing and uniformly heatsetting the fabric. The heatset and dyed fabric is then removed from the chamber and washed to remove residual solvent.

BRIEF DESCRIPTION OF THE DRAWINGS

The invention will be further explained with reference to the attached drawings in which.

DETAILED DESCRIPTION OF THE DRAWINGS

Figure 1:
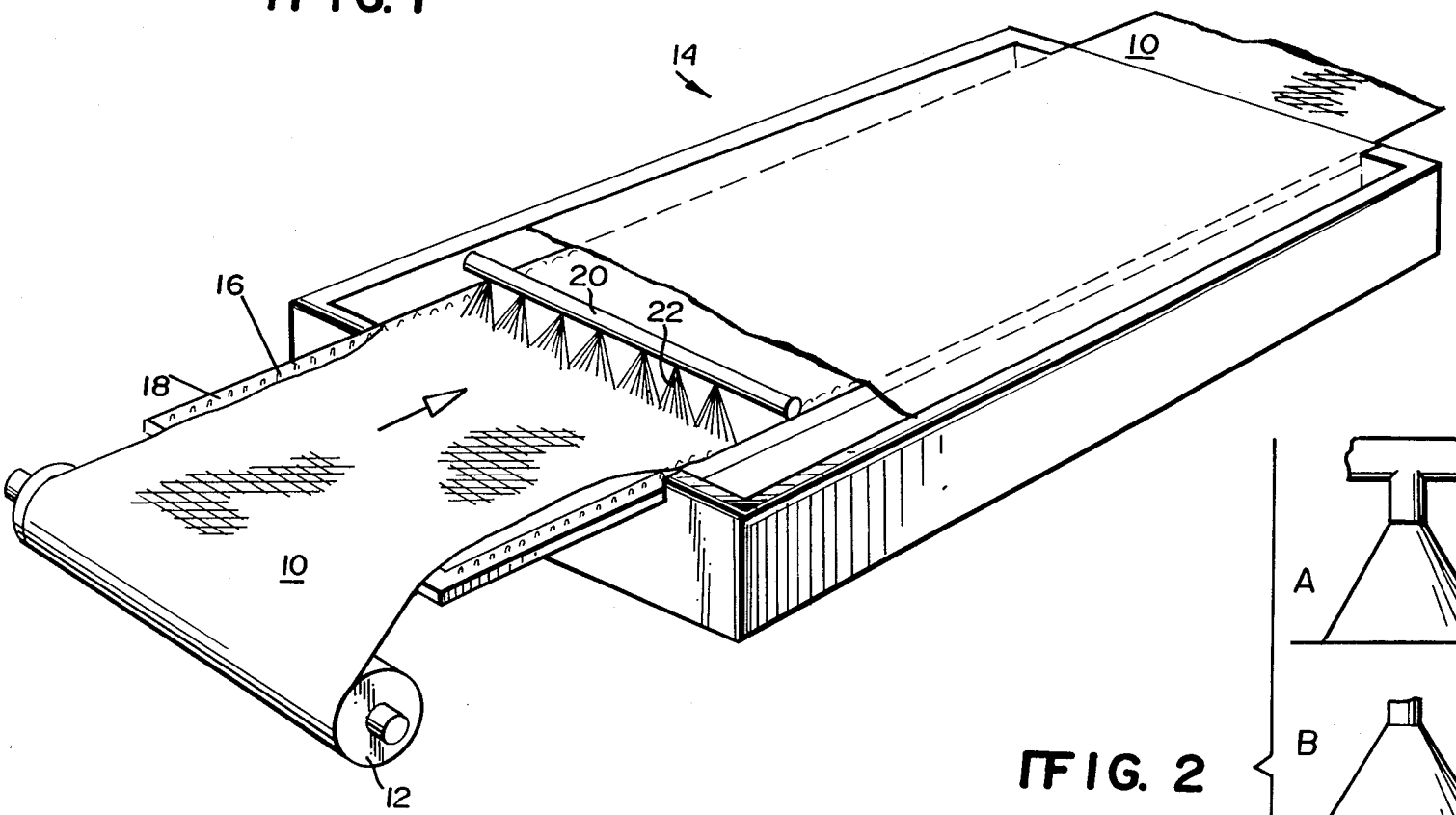
FIG. 1 is an elevated perspective view of a tenter frame, with the top partially broken away, and related apparatus for carrying out the process of this invention.

The fabric to be treated 10 is held on a roll 12 and delivered to the opening of a tenter frame 14 for attachment to the pins 16 on the endless chains 18 on either side of the frame. The fabric 10 moves in the direction of the arrow into the frame, which is maintained at an elevated temperature via internal or external heaters (not shown), and is immediately contacted with a spray of the high-boiling solvent dye dispersion delivered in this illustration by a spray manifold 20, the several individual spray heads 22 mounted on it. The spray heads are depicted in more detail in FIG. 2. The high-boiling solvent dye dispersion is applied at elevated temperature to the fabric while in open width in the heated tenter frame, preferably after the high-boiling solvent dye dispersion has been heated to a temperature about the same as the tenter frame, the manifold being supplied with heated dye dispersion from a container and pump device (not shown). The tenter frame 14 is itself fully enclosed and is shown, for purposes of illustration, with the top portion partially broken away to expose the enclosed spray manifold and spray heads. The enclosed area may be provided with openings or a series of baffles to restrict access of the ambient air and thus operated under non-reactive conditions, such as with an inert gas, for instance nitrogen, Freon or the like. Conducting the process in a non-reactive atmosphere while requiring special equipment (not illustrated in the drawing) prevents or substantially prevents the high-boiling solvent from deteriorating under high temperature operating conditions.

Although initially preheated to a temperature approximating that of the tenter frame, the temperature of the high-boiling solvent dye dispersion in spray form drops significantly after it leaves the spray nozzle. The fabric is held for a period of time, depending upon fabric speed, length of the tenter frame and other variables, in tenter frame 14 under elevated temperatures and under transverse tension until the dye-laden fabric's temperature increases to approximately that of the interior of the tenter frame and the fabric is both heatset and suitably dyed. Following this, the dyed fabric is taken from the frame 14 and subjected to further processing such as scouring with 1,1,1-trichloroethane or other suitable organic solvent (not shown).

Figure 2:
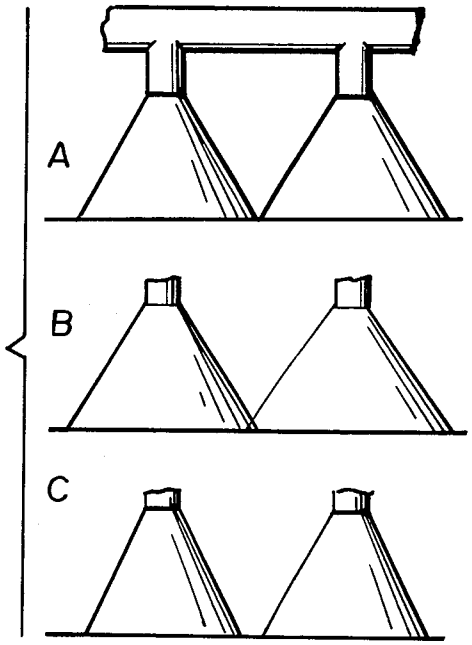
FIGS. 2A, B and C are three different perspective plan views of spray head arrangements illustrating optimum (A) and less than optimum (B,C) spray placement.

FIG. 2 depicts various arrangements of adjacent spray nozzles. The ideal arrangement is in FIG. 2A in which the spray patterns are arranged so as to meet the spray area of the adjacent nozzle and provide a uniform application of the dye composition. In FIG. 2B there is an overlap which delivers an excessive amount of dye composition to the fabric in the area of overlap, while in FIG. 2C there is a gap between the adjacent spray patterns leaving an uncovered area. The procedure of this invention is very forgiving in that variances from the ideal are well-tolerated because the high-boiling solvent dye dispersion readily migrates in the fabric being treated under the elevated operating conditions. This means that the dye composition applied to the fabric spreads evenly and the resulting dyed and heatset product presents a level shade.

Disclosed is a process for applying high-boiling solvent dye dispersions to a fabric while in open width and restrained from transverse movement. The process permits the operator to achieve the full advantages of operating with the high-boiling solvent dye dispersion since the dyes migrate evenly across the fabric width conveniently moving to areas not covered and away from areas that have received an excessive application. In this process, the high-boiling solvent dye dispersion is heated to the approximate operating temperature, generally within the range of 350° to 450° F., and preferably within the range of 380° to 400° F., then sprayed or otherwise applied to the fabric as it is held on a width-holding chain, such as in a tenter frame.

The tenter frame consists of a pair of endless chains on horizontal tracks, each chain provided with pins or clips on which to firmly hold the fabric by its edges. Initially, as the fabric is led into the frame, the pair of endless chains are held closer together, then, once the fabric is securely attached to the pins or clips, the chains diverge as they advance through the heated chamber, and in this manner the fabric is adjusted to the desired width and held securely when exposed to elevated temperatures to complete the requisite heatsetting. Controls associated with the spraying process allow the operator to vary the dye dispersion application width as the width of the fabric changes. The fabric is presented to the spray of high-boiling solvent dispersion in a substantially horizontal, open width manner which allows for side-center-side as well as end-to-end evenness of shade.

The high-boiling solvent dye dispersion is heated to an elevated temperature, generally within the range of 350° to 450° F., as stated above. The temperature of this dispersion drops significantly after it leaves the spray nozzle(s) even though the nozzles are enclosed in the heated environment of the tenter frame, thus while the high-boiling solvent dye dispersion initially is heated to a temperature approximating the operating temperature of the tenter frame, as it is applied and sprayed onto the fabric it reaches a temperature below the surrounding environment. Residence time in the tenter frame heats the dye solvent dispersion-coated fabric to a higher temperature (second elevated temperature), then the initial dye solvent dispersion application temperature (first elevated temperature) in the enclosed chamber while the solvent dye dispersion is in contact with the fabric causing the dye composition to migrate and thereby uniformly dyeing the fabric. Prior proposals as exemplified by U.S. Pat. Nos. 4,550,579 and 4,055,971 apply the dye-containing dispersion at a single temperature and maintain the dye dispersion soaked article at that temperature. The use of a two step or two level heating process is believed to be unique and is thought to allow the dye composition to migrate and thereby uniformly dye the fabric.

Solvents suitable for carrying out the process of this invention include, among others, those described in one or more of the following U.S. Pat. Nos. 4,293,305; 4,394,126; 4,426,297; 4,529,405; and 4,581,035. These materials are characterized generally as aromatic esters or cycloaliphatic diesters, and the disclosures of the patents just mentioned are hereby incorporated by reference.

The non-aqueous, high-boiling solvent dispersion is applied to the fabric while held in open width form. The method of application is generally described as non-contact in that the dye dispersion is brought into contact with the fabric rather than the other way around, as for instance in a pad bath or vat or beck in which the fabric is led through a quantity of dyeing liquid retained in a vessel or container.

EXAMPLE

In the process of this invention, the high-boiling solvent dye composition is applied to one side only of an open width fabric. The dye composition levels evenly and penetrates thoroughly through the fabric. In a specific example, a dye composition was prepared by dispersing 3.4% of the following crude disperse dyes in tris(2-ethylhexyl)trimellitate to produce an olive green shade: 1.45% of Disperse Yellow 54, 0.14% of Disperse Red 92, 0.82% of Disperse Orange 29 and 0.72% of Disperse Blue 56. This high-boiling solvent-dye composition was applied to a 12-inch wide sample of high-tenacity nylon 6,6 (Cordura, commercially available from duPont), which has been prescoured with an aqueous solution of 0.5% of BI-CHEM NID, a nonionic detergent available from Burlington Industries Chemical Division. An array of No. 80067 Unijet spray nozzles mounted in a manifold perpendicular to the direction of travel sprayed 8.5 ounces per minute of the dye composition at 350° F. onto the fabric under a pressure of 40 psi to achieve a 45% wet pick-up. Spray temperature dropped to 325° F. before contacting fabric.

The fabric was held on a pin frame and purposely moved erratically under the spray in order to obtain differing wet pick-up values and to provide obvious spray pattern boundaries. In addition, the spray heads were adjusted to leave a one-inch gap between adjacent sprayed areas. To accentuate further the leveling action of the process of this invention, the fabric was then processed in a Benz oven while on the pin frame at only 380° F. for 30 seconds, an unusually short exposure since most fabrics of this character would be exposed in the Benz oven for 30 seconds at 405° F., or 45 seconds at 390° F. Following this treatment, the fabric was cooled and scoured with 1,1,1-trichlorethane.

The scoured fabric showed no obvious signs of unevenness resulting from the one inch gap between sprayed areas and, in fact, some dyeing was seen up to two to three inches from the application boundaries. This test showed that even with intentionally uneven application of the dye generally level dyeing results and, of course, that the dye dispersed in the high-boiling solvent can be successfully applied to open-width fabric by spraying under the appropriate conditions.

Certain modifications and improvements will occur to those skilled in the art upon reading of the foregoing description. By way of example, the dye composition also may be applied by fluid jets, nozzles, showers, or sprinklers. In addition, a vacuum slot could be inserted across the chamber between the dye application and fabric heating regions to facilitate recovery of excess dye composition. It should be understood that all such modifications and improvements have been deleted herein for the sake of conciseness and readability but are properly within the scope of the following claims.

What is claimed:

1. A continuous process for simultaneously uniformly solvent dyeing and uniformly heatsetting a synthetic textile fabric in open width at an elevated temperature in a closed environment, the process comprising the steps of:

(a) providing a heated, enclosed chamber having an entrance, an exit, means to hold fabric by the edges in open width in the heated, enclosed chamber, means to adjust the fabric width while it is so held, a dye applicator for applying a dyestuff-containing dispersion directly to the fabric without the applicator directly contacting the fabric, and means to move the fabric through the chamber from the entrance to the exit;

(b) continuously supplying fabric in open width to the means for holding the fabric and passing the fabric through the heated, enclosed chamber while adjusting the fabric width, as required, as the fabric passes through the chamber;

(c) spraying a heated dispersion of a dyestuff dispersed in a non-aqueous, high-boiling solvent to the fabric in open width in the heated, enclosed chamber, the dispersion being sprayed onto the fabric at a temperature of from about 300° F. to about 400° F.; and (d) exposing the fabric to heat in the chamber, at a temperature of from about 350° F. to about 400° F. while the dye dispersion is in contact with the fabric and allowing the dye dispersion to migrate, penetrate thoroughly through the fabric and level substantially evenly across the entire width of the fabric thereby simultaneously uniformly dyeing and uniformly heatsetting the fabric; and (e) removing the heatset and dyed fabric from the chamber.

2. The process of claim 1, in which the dye dispersion is sprayed onto the fabric while it is held in open width.

3. The process of claim 1, in which a tenter frame holds the fabric by the edges in open width under conditions of transverse tension while the heated dispersion of dyestuff in the non-aqueous, high-boiling solvent is applied to the fabric and while the fabric is exposed to heat in the chamber.

4. The process of claim 1, in which the dispersion is sprayed onto the fabric at a temperature of from about 325° F. to about 380° F.

5. The process of claim 1, in which step (d) is conducted at a temperature in the range of from about 380° F. to about 400° F.

6. A continuous process for simultaneously uniformly solvent dyeing and uniformly heatsetting a synthetic textile fabric in open width at an elevated temperature in a closed environment, the process comprising the steps of:

(a) providing a heated, enclosed chamber having an entrance, an exit, means to hold fabric by the edges in open width in the heated, enclosed chamber, means to adjust the fabric width while it is so held, a dye applicator for applying a dyestuff-containing dispersion directly to the fabric without the applicator directly contacting the fabric, and means to more the fabric through the chamber from the entrance to the exit;

(b) continuously supplying fabric in open width to the means for holding the fabric and passing the fabric through the heated, enclosed chamber while adjusting the fabric width, as required, as the fabric passes through the chamber;

(c) heating a dispersion of a dyestuff dispersed in a non-aqueous, high-boiling solvent to a temperature of about 300° F. to about 400°F.; and spraying the heated- dyestuff dispersion to the fabric in open width in the heated, enclosed chamber at a first temperature;

(d) heating the fabric in the chamber at a second, higher temperature at least 25° F. higher than the first mentioned temperature and in a range of from about 350° F. to about 450° F. while the dye dispersion is in contact with the fabric and allowing the dye dispersion to migrate, penetrate thoroughly through the fabric and level substantially evenly across the entire width of the fabric thereby simultaneously uniformly dyeing and uniformly heatsetting the fabric; and (e) removing the heatset and dyed fabric from the chamber.

7. The process of claim 6, in which the dispersion is sprayed onto the fabric at a temperature of from about 300° F. to about 350° F.

8. The process of claim 6, in which the heated dye dispersion is sprayed onto the fabric while it is held in open width.

9. The process of claim 6, in which a tenter frame holds the fabric by the edges in open width under conditions of transverse tension while the heated dispersion of dyestuff in the non-aqueous, high-boiling solvent is applied to the fabric and while the fabric is exposed to additional heat in the chamber.

* * * * *